United States Patent [19]

Hathaway

[11] 3,948,423

[45] Apr. 6, 1976

[54] AUXILIARY GUN SLING

[76] Inventor: David J. Hathaway, Rte. 2, Box 155, Sandpoint, Idaho 83864

[22] Filed: June 13, 1974

[21] Appl. No.: 478,861

[52] U.S. Cl. ..... 224/1 A
[51] Int. Cl.[2] ..... F41C 33/00
[58] Field of Search ..... 224/1 R, 1 A, 5 Z, 46 R, 224/45 S, 52, 55, 58

[56] References Cited

UNITED STATES PATENTS

| | | | |
|---|---|---|---|
| 946,850 | 1/1910 | Tabler | 224/55 |
| 1,075,997 | 10/1913 | Thomas | 224/55 |
| 2,830,747 | 4/1958 | Cleste | 224/1 A |
| 2,915,233 | 12/1959 | Mooman | 224/1 R |
| 3,441,185 | 4/1969 | Mooman | 224/1 R |
| 3,495,770 | 2/1970 | Seltmann, Jr. et al. | 224/1 A |

FOREIGN PATENTS OR APPLICATIONS

| | | | |
|---|---|---|---|
| 533 | 3/1905 | United Kingdom | 224/1 A |
| 287,771 | 2/1930 | Italy | 224/5 Z |

*Primary Examiner*—Robert J. Spar
*Assistant Examiner*—Kenneth Noland
*Attorney, Agent, or Firm*—Wells, St. John & Roberts

[57] ABSTRACT

An auxiliary gun sling, mountable to a rifle or shotgun, is utilized in combination with a conventional gun sling to securely hold a rifle or shotgun to the user's body when the weapon is not in use, and to facilitate a firm grip on the weapon as it is being fired. The sling is comprised of an elongated elastically extensible resilient strap having snap clips at either end for releasably mounting the strap to the front and back sling swivels of a rifle or shotgun. The auxiliary sling assures the user free use of both hands while carrying the weapon and facilitates quick and smooth movement of the weaponn from a carrying position to a firing position. At the firing position the tension of the resilient strap serves to hold the weapon firmly against the user's shoulder. The strap acts in conjunction with the conventional sling to firmly position the rifle barrel by bracing the user's rifle-supporting arm.

3 Claims, 4 Drawing Figures

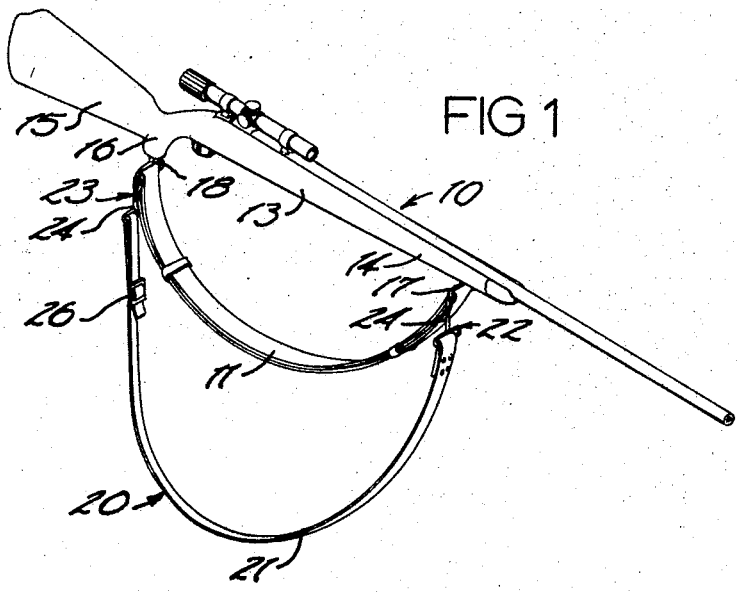
FIG 1
FIG 2
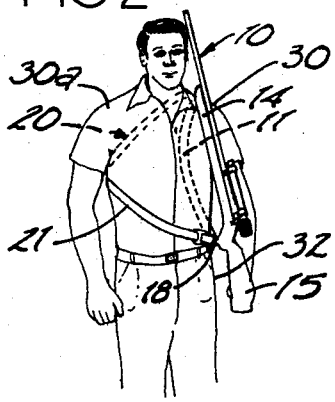
FIG 3
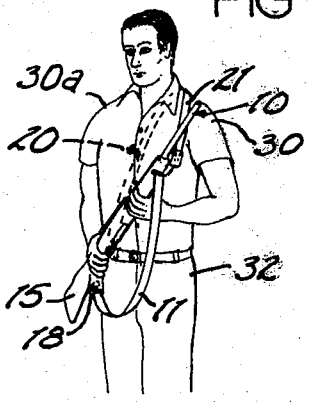
FIG 4
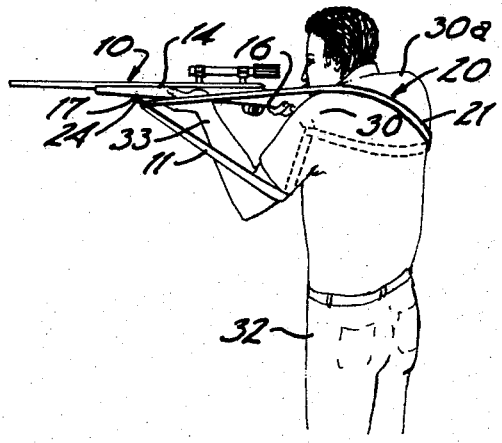

AUXILIARY GUN SLING

BACKGROUND OF THE INVENTION

The present invention relates basically to small arms carrying straps or slings, and more particularly to such slings that may be utilized in combination with a conventional sling to provide additional carrying stability and to assist the user in steadily supporting the weapon in a firing position.

The primary purpose of a gun sling is to carry a shotgun or rifle while leaving the user's hand free for other purposes. Further, the weight of a usually heavy rifle or shotgun when supported on the user's shoulder substantially reduces fatigue while hunting. The primary difficulty with conventional military or standard gun slings is that they allow the weapon to work itself off the user's shoulder or to jostle about as the user walks along, causing general discomfort.

This problem has been realized to some degree in the disclosure found in U.S. Pat. No. 3,495,770, titled "weapon sling." This patent teaches the use of a sling for carrying a weapon diagonally across the front of a user's torso. The sling is comprised of two integral portions. The first portion is comprised of a strap extending from the butt of the weapon to the weapon forearm. A second strap is also provided that extends from a point on the first strap adjacent to the weapon butt to a point on the first strap adjacent to the forearm. A loop is thereby formed intermediate the ends of the first strap. The user positions the strap so his torso from one shoulder to a side opposite to the shoulder is enveloped within the loop. The second strap is freely slidable within a ring on the second loop to enable the weapon to be moved from a carrying position to a firing position. To securely hold the weapon in the carrying position, a hook is necessary to limit the operational length of the first strap. The hook must be unclasped to allow free movement of the weapon to a firing position.

A similar arrangement is disclosed in U.S. Pat. No. 3,441,185. This patent utilizes a single strap that supports a weapon diagonally across the front of a user's torso. The strap also extends diagonally about the user's torso from one shoulder to an opposite side adjacent to the user's hip. A slide ring is also provided that enables the weapon to be moved from the carrying position to a firing position. A hook is provided to prevent free movement of the weapon to a firing position. This hook must be released before the user is able to move his weapon to a firing position.

Other patents of interest are: U.S. Pat. No. 2,873,902 which describes a pivotable gun support for carrying a rifle at a single pivot point; U.S. Pat. No. 3,098,591 which discloses a gun carrying harness which also includes a hook that must be undone before the weapon may be brought to a firing condition; U.S. Pat. No. 2,779,521 which discloses a carrying and supporting sling similar to the conventional-type sling, but utilizing a rubber friction resistance element to secure the sling to a user's shoulder; and U.S. Pat No. 2,884,172 which discloses a gun sling similar to conventional slings, but utilizing a muzzle cap to secure one end of the sling to the weapon and a butt strap to secure the sling at the butt end of the weapon.

The sling of the present invention is utilized in combination with a conventional gun sling to securely and snugly hold a weapon against a user's side while being carried. The sling allows free and smooth movement of the weapon from the carrying position to a firing position, while simultaneously holding the weapon snugly against the user's shoulder and bracing it against the user's weapon-supporting arm.

SUMMARY OF THE INVENTION

An extensible resilient sling for use in combination with conventional gun slings is described for holding a rifle or shotgun securely to a user's torso. The sling is comprised of a resilient elongated extensible strap having first and second mounting means for attaching the ends of the strap to the rifle or shotgun adjacent the forearm and butt respectively. The strap is of sufficient length, in a substantially non-extended condition when the rifle or shotgun is held in a carrying position adjacent the user's body, to wrap diagonally about the user's torso from back to front; starting from a position where the first mounting means and associated sling swivel are located adjacent to the user's shoulder, and ending at a position wherein the second mounting means and associated sling swivel are located adjacent the user's hip on the same side as the shoulder. The strap is also of sufficient extensible length, when the rifle or shotgun is held in a firing position, to enable it to wrap around the user's torso; from a position where the first mounting means and associated sling swivel are located adjacent to the user's hand supporting the forearm of the rifle or shotgun around the user's torso and forwardly to a position where the second mounting means and associated sling swivel are located adjacent the user's other hand.

It is a first object to provide an auxiliary gun sling that may be utilized with substantially any conventional non-extensible gun sling to assist in firmly holding a supported weapon against a user's body when the weapon is held in a carrying position, to allow complete freedom of the user's arms and hands.

It is a further object to provide such a gun sling that assures free unrestricted movement of the weapon from a carrying position to a firing position.

It is a further object to provide such a sling that, in the firing position of the weapon, provides additional support or bracing to thereby facilitate accurate shooting.

Another object is to provide such a sling that is easily attached to and removable from conventional sling swivels presently provided on modern hunting weapons.

These and other objects and advantages will become apparent upon reading the following description which, taken along with the accompanying drawings, discloses a preferred form of the present invention.

BRIEF DESCRIPTION OF THE DRAWINGS

FIG. 1 is a pictorial view of a rifle with the sling of the present invention mounted thereto;

FIG. 2 is a pictorial view of the sling showing its relative condition when wrapped about the torso of a user's body;

FIG. 3 is an operational view showing the relative position of the sling as the user moves the weapon toward a firing condition; and FIG. 4 is a pictorial view of the sling when the user is holding the weapon in a firing position.

DETAILED DESCRIPTION OF A PREFERRED EMBODIMENT

The device of the present invention is shown in the accompanying drawings for use in conjunction with a rifle 10 and a conventional sling 11. Although a rifle is shown, it should be understood that the present device may also be utilized with a shotgun or any other long-barrel, hand-held weapon.

Rifles such as that shown at 10 generally include a wooden stock 13 that is comprised of a forearm section 14 and a butt section 15. Forearm section 14 serves to bed the gun barrel and provides a gripping surface for the user's hand, as shown in FIG. 4. The butt 15 of the rifle presents a surface for engaging the user's shoulder and usually includes a cheek rest for bracing the user's head while aiming the rifle. When firing the rifle, the user grips the forearm 14 with one hand and a pistol grip portion 16 with the other hand while firmly holding the butt portion 15 against his shoulder and cheek. This position is shown in FIG. 4.

When carrying the rifle, the user utilizes sling 11 as shown in FIG. 2 to hold the rifle in an upright condition against one side of his torso. It is through operation of an auxiliary sling 20 of the present invention that the rifle is held snugly against the user's torso in the carrying position shown in FIG. 2. The sling 20 also operatively assists the user in accurate aiming of the rifle when held in a firing position as shown in FIG. 4.

FIG. 1 shows the conventional sling 11 and the extensible resilient sling 20 of the present invention mounted to the rifle 10. A front sling swivel 17 is provided on forearm 14 to mount forward ends of the slings 11 and 20. A back sling swivel 18 mounts the rearward ends of the slings. The back sling swivel 18 is shown mounted to the pistol grip portion 16. This location is not intended to be restricted as illustrated, but may be located at other positions along the rifle butt portion 15.

The elastically extensible resilient sling 20 of the present invention is basically comprised of a strap 21 having a first mounting means 22 at one end and a second mounting means 23 at an opposite end. The strap 21 is constructed of an extensible resilient material, such as rubber, that enables it to be extended from a length operative to hold the rifle 10 in the carrying position (FIG. 2). It is also sufficiently extensible to enable elongation to a condition as shown in FIG. 4.

The first and second mounting means 22, 23 are comprised of identical snap clips 24 that may be releasably connected to the front and back sling swivels 18 and 19.

The operative length of the unextended or relaxed strap 21 may be selectively adjustable through means of a friction slide 26 (FIG. 1). Slide 26 enables the sling 20 to be adjusted to accommodate for heavy hunting clothing worn by the user or for the physical size of the user.

FIGS. 2, 3 and 4 in the drawing may be utilized to demonstrate the functional operation of auxiliary sling 20 in conjunction with conventional sling 11. In the carrying position (FIG. 2), the rifle is carried in an upright condition with conventional sling 11 extending downwardly from front sling swivel 17 at the user's shoulder 30 to the back sling swivel 18 at the user's hip 32. This enables vertical support of the rifle on the user's shoulder, but does not prevent the sling from sliding down the shoulder 30 and off the user's arm. It is a purpose of the sling 20 in this position to securely hold the rifle 10 to the user's side.

To accomplish this, sling 20 is arranged in a winding spiral fashion about the user's torso. In this condition, sling 20 extends from front sling swivel 17 at a point adjacent the user's shoulder 30 diagonally downward across his back, around his side between torso and arm, then diagonally downward again to finally connect to back sling swivel 18 at a point adjacent the front of the user's hip 32. It is intended that the operational length of strap 21 be such that when arranged in the described position, the sling is slightly extended to provide a pulling force against the rifle 10, securing it snugly against the user's side.

It may be noted from the drawing that the rifle 10 is held at the user's left side, since he is obviously a right-handed shooter. All described arrangements and functions however may easily be accomplished with the rifle 10 positioned on the user's right-hand side.

FIG. 3 shows the rifle being held at a ready position or a position intermediate the carrying position (FIG. 2) and the firing position (FIG. 4). To move the rifle to this position, the user simply lifts the rifle slightly while shrugging his shoulder 30 from between the forearm 14 and sling 11. This movement frees the shoulder and arm from between the gun stock 13 and sling 11, and enables the user to move the rifle to the ready position with resistance offered only by strap 21 as it extends.

It should be emphasized that strap 21 does not cause a substantial amount of frictional resistance to sliding movement as it is pulled across the user's clothing. To the contrary, sliding movement of the strap is desirable to enable free movement of the rifle from the carrying position to the ready position and finally to the firing position.

To bring the rifle 10 to a firing position as shown in FIG. 4, the user simply raises the rifle barrel in a forward and outward motion while simultaneously raising the butt 15 to engage his other shoulder 30*a*. During this motion the strap 21 is extended substantially beyond the length illustrated in FIGS. 2 and 3. Therefore, a certain amount of tension is applied along the strap 21 to pull the rifle rearwardly into the user's shoulder 30*a*. Such a pulling force is a desirable feature since accurate shooting depends on a snug or firm engagement between the shoulder 30*a* and butt 15.

Another feature is realized when conventional sling 11 is utilized in combination with the sling 20 to brace the user's forearm and hand 33 that supports the rifle forearm 14. This arrangement provides a suitable rest that is substantially more stationary than would normally be possible with the user supporting the rifle forearm without the aid of slings 11 and 20.

To move the rifle back to a carrying position, the user simply reverses the above-described procedure.

It may have become evident upon reading the above description and in view of the attached drawings, that various changes and modifications may be made therein without departing from the scope of this invention. Therefore only the following claims are to be taken as definitions of my invention.

What I claim is:

1. An extensible resilient auxiliary sling for use in combination with a conventional gun sling for holding a rifle or shotgun securely to the user's body, said auxiliary sling comprising:

an elongated resilient and elastic extensible strap having a smooth outer surface to present minimal frictional resistance to sliding movement over a user's clothing;

first mounting means for attaching one end of the strap to a sling swivel on the forearm of a gun stock;

second mounting means for attaching the remaining end of said strap to a sling swivel on the gun stock adjacent the butt;

said strap being of sufficient length in a substantially nonextended or relaxed condition whtn the rifle or shotgun is held in a carrying position to wrap in a winding spiral fashion about the user's torso from back to front starting from a position where the first mounting means and associated sling swivel are located adjacent to one of the user's shoulders and ending at a position where the second mounting means and associated sling swivel are located adjacent the front of the user's hip on the same side as said one shoulder; and said strap being capable of extending sufficiently, when the rifle or shotgun is held in a firing position, to wrap around the user's torso from a position where the first mounting means and associated sling swivel are located adjacent to the user's hand supporting the forearm of the rifle or shotgun, around the user's torso and forwardly to a position wherein the second mounting means and associated sling swivel are located adjacent the user's other hand.

2. The invention set out in claim 1 further including a friction slide mounted to the strap to facilitate selective adjustment of the strap length.

3. The invention set out in claim 1 wherein the first and second mounting means is comprised of snap clips mounted at opposite ends of the strap for releasably engaging the sling swivels.

* * * * *